US009221166B1

(12) United States Patent
Jacobs et al.

(10) Patent No.: US 9,221,166 B1
(45) Date of Patent: Dec. 29, 2015

(54) PROTECTIVE SHIELD FOR HAND-HELD TOOLS

(71) Applicants: Ronald Jacobs, Bakersfield, CA (US); Mark Gardner, Bakersfield, CA (US); John Randolph Fisher, San Ramon, CA (US)

(72) Inventors: Ronald Jacobs, Bakersfield, CA (US); Mark Gardner, Bakersfield, CA (US); John Randolph Fisher, San Ramon, CA (US)

( * ) Notice: Subject to any disclaimer, the term of this patent is extended or adjusted under 35 U.S.C. 154(b) by 0 days.

(21) Appl. No.: 14/313,880

(22) Filed: Jun. 24, 2014

Related U.S. Application Data

(60) Provisional application No. 61/838,500, filed on Jun. 24, 2013.

(51) Int. Cl.
*B25G 1/00* (2006.01)
*B25G 1/10* (2006.01)

(52) U.S. Cl.
CPC ... *B25G 1/00* (2013.01); *B25G 1/10* (2013.01)

(58) Field of Classification Search
CPC ..... B25G 1/10; B25G 1/102; B25G 1/105; B25G 3/20; B25G 3/24; B25G 1/00; B25F 5/024; B25F 5/026; A45C 13/22; E05B 1/0061
USPC ..... 16/406, 413, 422, 426, 430
See application file for complete search history.

(56) References Cited

U.S. PATENT DOCUMENTS

| | | | | | |
|---|---|---|---|---|---|
| 271,303 | A * | 1/1883 | Blaker | 30/308.1 |
| 758,482 | A * | 4/1904 | Smith | 16/422 |
| 1,386,342 | A * | 8/1921 | Letchworth | 74/543 |
| 1,463,191 | A * | 7/1923 | Batten | 280/762 |
| 3,227,455 | A * | 1/1966 | Hulsman | 473/206 |
| 3,751,094 | A * | 8/1973 | Bohler | 294/58 |
| 4,627,618 | A * | 12/1986 | Schwartz | 482/108 |
| 4,701,142 | A * | 10/1987 | Merritt | 440/101 |
| 5,065,475 | A * | 11/1991 | Watt | 16/426 |
| 5,606,772 | A * | 3/1997 | Ilic | 16/421 |
| 6,009,600 | A * | 1/2000 | Egeland et al. | 16/436 |
| 2007/0101547 | A1 * | 5/2007 | Egeland | 16/430 |

* cited by examiner

*Primary Examiner* — Roberta Delisle
(74) *Attorney, Agent, or Firm* — R. Scott Kimsey; Klein DeNatale Goldner

(57) ABSTRACT

A protective device for a hand-held tool includes a protective shield having a first end and an opposing second end, a first clamp portion attached to the first end of the protective shield, and a second clamp portion removably attached to the first clamp portion. The first and second clamp portions are configured to securely fix a portion of the handle of the hand-held tool therebetween when the second clamp portion is attached to the first clamp portion.

18 Claims, 6 Drawing Sheets

PROTECTIVE SHIELD FOR HAND-HELD TOOLS

RELATED APPLICATIONS

The present application claims priority of U.S. Provisional Patent Application No. 61/838,500, filed Jun. 24, 2013 and entitled "Protective Shield for Hand-Held Tools," which application is incorporated here by reference in its entirety.

FIELD

The present disclosure relates generally to a device for protecting tool users from injury, and more particularly to protecting the hand of a user from injury when the user is making forceful striking motions with the tool.

BACKGROUND

Tools such as hammers are well known in the art. These hand-held tools often require vigorous, forceful motion on the part of the user of the tool in order to strike or otherwise impact the intended target with the tool. This forceful motion exposes the hand grasping the tool to injury. This is particularly true when the tool is being used to strike curved, slanted, or uneven surfaces. Using a hammer to strike a portion of pipe, for example, or to strike a nail on a slanted surface such as a roof, can result in forcefully impacting the pipe or the roof with the knuckles of the hand. This is due to the angle of the hammer or other tool as it is being used, and to the relative angle of the surface being struck to the motion of the tool. In industries where use of tools in the above manner is common, injuries to the hands of the users may result from striking the hand against hard surfaces while holding a tool.

What is needed, therefore, is an efficient device for protecting a user's hand from injury while using such tools, while at the same time allowing the worker to continue working in the same manner, and at the same speed, as when using a tool without such a protective device.

SUMMARY

The present disclosure provides a protective device for a hand-held tool. The device includes a protective shield having a first end and an opposing second end, a first clamp portion attached to the first end of the protective shield, and a second clamp portion removably attached to the first clamp portion. The first and second clamp portions are configured to securely fix a portion of the handle of the hand-held tool therebetween when the second clamp portion is attached to the first clamp portion.

The first clamp portion may define at least one opening for receiving a fastener, while the second clamp portion may define at least one corresponding opening for receiving a fastener. A fastener extends through the opening defined in the second clamp portion and is received in the opening defined in the first clamp portion, thereby securing the second clamp portion to the first clamp portion.

The protective device may further include a base attached to the second end of the protective shield, the base being configured to receive a portion of the handle of the hand-held tool.

The base may define an opening substantially aligned with a space defined between the first and second clamp portions, the opening in the base configured to receive a second portion of the handle of the hand-held tool thereth rough.

The base portion may comprise a sidewall extending therefrom to form a pocket substantially aligned with the space defined between the first and second clamp portions. The pocket may be configured to receive the end of the handle of the hand-held tool.

The protective device may further include a third clamp portion attached to the second end of the protective shield, and a fourth clamp portion removably attached to the third clamp portion. The third and fourth clamp portions are substantially in alignment with the first and second clamp portions and configured to securely fix a second portion of the handle of the hand-held tool therebetween when the fourth clamp portion is attached to the third clamp portion.

Another aspect of the disclosure provides an improvement for a hand-held tool having a head and a handle extending from the head. The improvement includes a protective shield attached to the handle and extending from the handle at a first location therealong to a second location on the handle. The first location is nearer the head of the tool than the second location. The protective shield is configured to receive a portion of a user's hand when the user is grasping the tool, and the protective shield forms a barrier to protect at least a portion of the user's hand.

The protective shield may have a concave curvature along at least a portion of its length that extends over the hand of the user.

The protective shield may be removably attached to the hand-held tool.

The protective shield may be formed as a unitary, integral component of the hand-held tool.

An embodiment of the protective device for a hand-held tool may include a protective shield, a first attachment portion configured to secure a first portion of the protective shield to a first portion of the handle of the hand-held tool, and a second attachment portion configured to secure a second portion of the protective shield to a second portion of the handle of the hand-held tool.

The first attachment portion may include a clamp releasably attached to the first portion of the handle of the hand-held tool.

The second attachment portion may include a base with a sidewall extending therefrom to form a pocket configured to receive the end of the handle of the hand-held tool.

The protective device may include a sleeve with a first, open end attached to the first attachment portion of the protective shield, and a second, opposing end attached to the second attachment portion of the protective shield. The sleeve may be configured to receive a portion of the handle of the hand-held tool through the first, open end thereof.

The protective shield, first attachment portion, second attachment portion, and sleeve may be formed as a unitary, integral device.

The sleeve may include a protective coating.

The hand-held tool may be a hammer, a mallet, an axe, or a pick.

DETAILED DESCRIPTION

Figure 1:
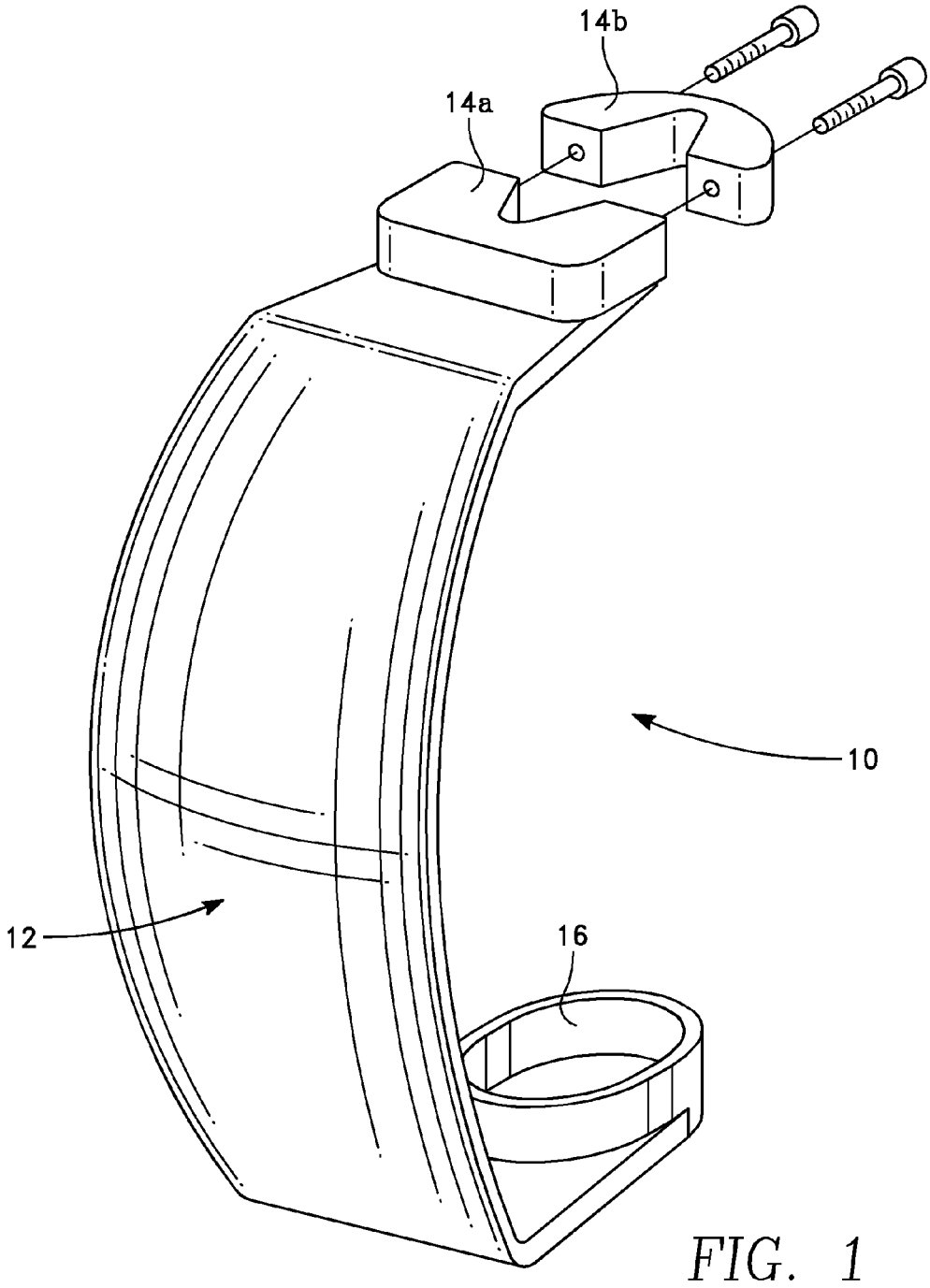
FIG. 1 is a front side perspective view of one embodiment of the protective device.

In one embodiment, the protective device includes a protective shield having a first end and an opposing second end, a first clamp portion attached to the first end of the protective shield, and a second clamp portion removably attached to the first clamp portion. The first and second clamp portions are configured to securely fix a portion of the handle of the hand-held tool therebetween when the second clamp portion is affixed to the first clamp portion. Examples of hand-held tools that can be used with the protective device include but are not limited to hammers (e.g. sledge hammer, claw hammer, ball-pein hammer, etc.), mallets, axes, picks, and the like.

Turning now to the drawings, wherein like numeral indicate like parts, numeral 10 refers generally to an embodiment of protective device. The embodiment of protective device 10 shown in the Figures includes a protective shield 12, a clamp 14 (preferably comprised of a first clamp portion 14*a* and a second clamp portion 14*b*), and a base 16. Protective shield 12 protects the hand of the tool user from injury due to striking fingers or knuckles against a work surface when the tool is in use. Clamp 14 secures protective device 10 to the handle of a tool, and base 16 receives the base of the handle of the tool, thereby further securing protective device 10 to the tool.

Figure 2:
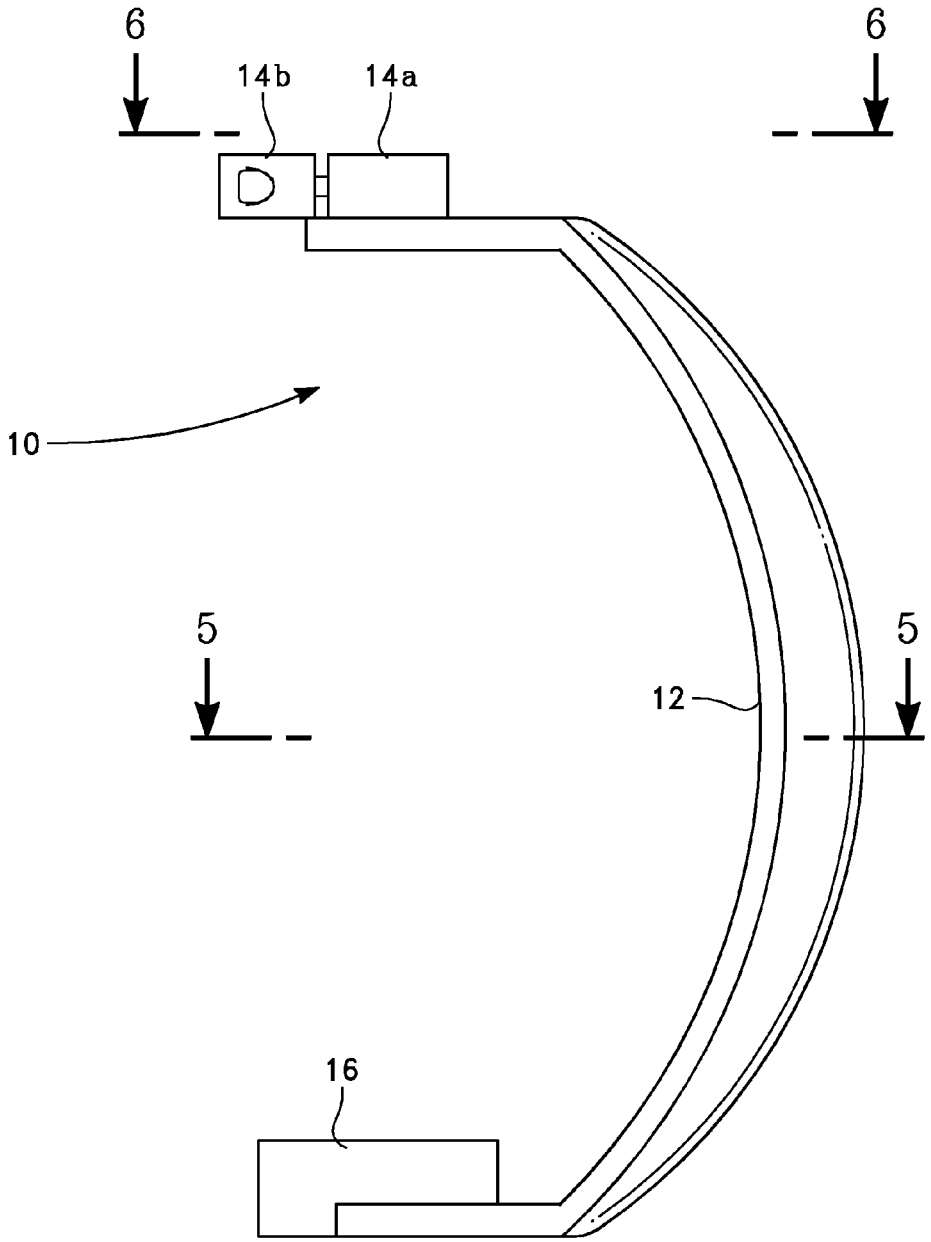
FIG. 2 is a side elevation view of one embodiment of the protective device.

FIG. 2 shows a side view of one embodiment of the protective device 10. As is shown in the figure, this embodiment features a curved protective shield 12 having flat portions at each end thereof. Clamp 14, comprised of clamp portions 14*a* and 14*b*, is fixedly attached to the flat portion at the upper end of protective shield 12, whereas base 16 is fixedly attached to the flat portion at the lower end of the protective shield 12 and oriented to receive the base of the handle of the tool to which protective device 10 is attached. In the embodiment shown in the figures, base 16 includes a sidewall structure that extends upwardly from the base. This sidewall structure forms a pocket open at the top end, and closed by the base at the bottom end, that is configured to receive the end of the handle of a hammer or other hand-held tool on which the present device 10 is to be used. The sidewall structure can be configured to form a pocket of different sizes and shapes (e.g. circular, square, etc.) to fit the end of the hand-held tool for use with the protective shield.

In one embodiment, the opening in the pocket (or, in other embodiments of the disclosure, other structure in the base of the present device configured to receive the end of the handle of the hand-held tool) is substantially aligned with an opening defined between first clamp portion 14*a* and second clamp portion 14*b*. By "substantially aligned," it is meant that these structures are aligned sufficiently to allow the end of a handle extending through the clamp portions to be received into the structure at the base portion.

Figure 3:
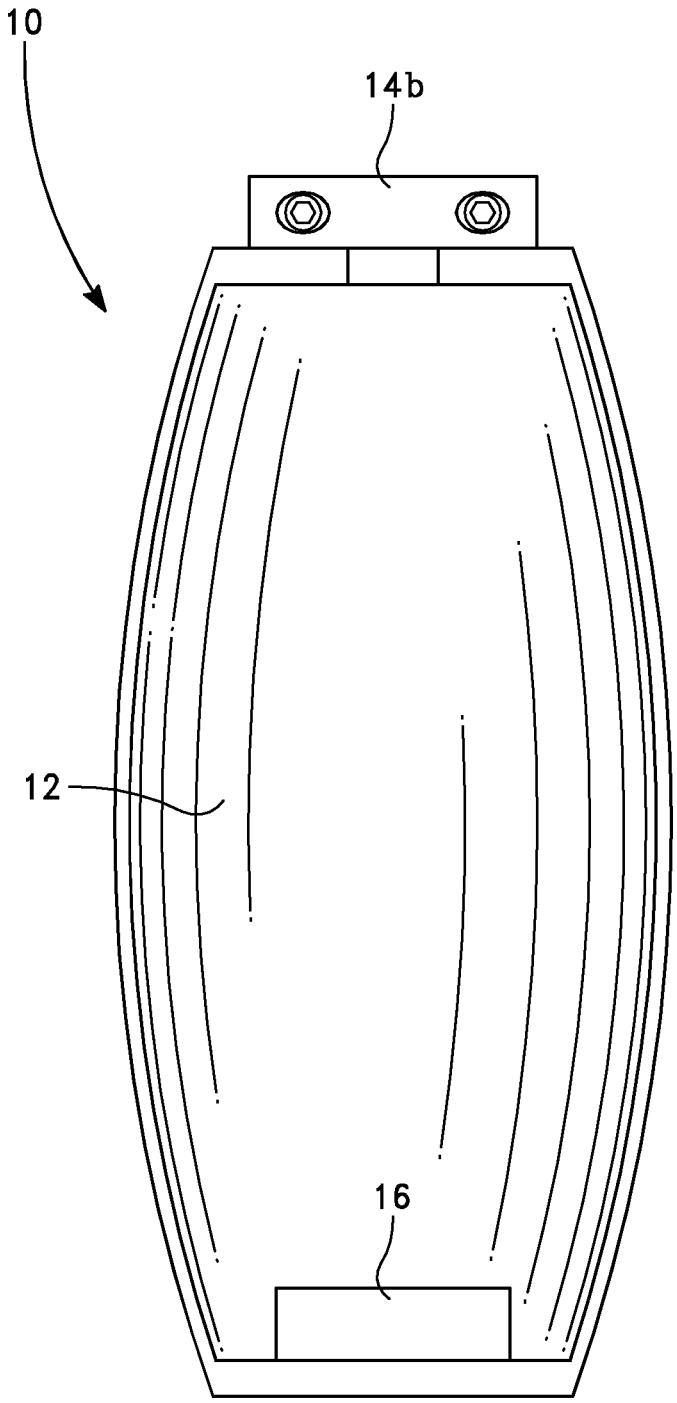
FIG. 3 is a rear elevation view of one embodiment of the protective device.

FIG. 3 provides a rear view of protective device 10, looking into the curvature of protective shield 12, with the outer, front surface of protective shield 12 facing away. For purposes of this disclosure, the "front" of protective shield 12 is the portion of protective shield 12 that strikes a work surface (instead of the hand of a user of the device) when the tool is being used. Clamp portion 14*b* is also visible in FIG. 3, as is base 16.

Although the figures depict protective device 10 being used in conjunction with a hammer, it is contemplated that protective device 10 may be used with any suitable tool, particularly any hand-held tool having a head and a handle extending away from the head. Further, although the figures depict attachment of protective device 10 at certain positions along the length of the handle of the hand-held too, the precise location of attachment of the various attachment portions (whether clamps, fasteners, or by any other suitable mechanism) may vary.

EXAMPLE

Construction of an Exemplary Embodiment of the Device

A method of constructing an exemplary protective device 10 is provided. It is noted that this method of construction is only an example of one method of construction, and that any suitable method of construction may be used to produce the protective device. Other suitable methods of construction will be readily apparent to those of skill in the art upon reading this disclosure.

In one embodiment, the pieces of protective device 10 are cut from a sheet of aluminum. Suitable aluminum includes 6000 series aluminum such as aluminum 6061-16 and 6061-1651, and 5000 series aluminum, such as aluminum 5052-H34. In another embodiment, protective shield 12 is comprised of 3/16" 5052 aluminum, clamp 14 is comprised of ½" 6061 T6 aluminum, and base 16 is comprised of ¾" 6061 T6 aluminum. Any suitable aluminum or other metal may be used. Methods of cutting aluminum or other sheet metal are known in the art. One such method suitable for cutting the parts of the present disclosure is the use of an OMAX® Waterjet (OMAX Corporation; Kent, Wash.), which uses a garnet and water at 50,000 PSI to cut through the metal. This approach does not heat the parts as they are being cut and does not affect the aluminum or other material in any manner.

Figure 4:
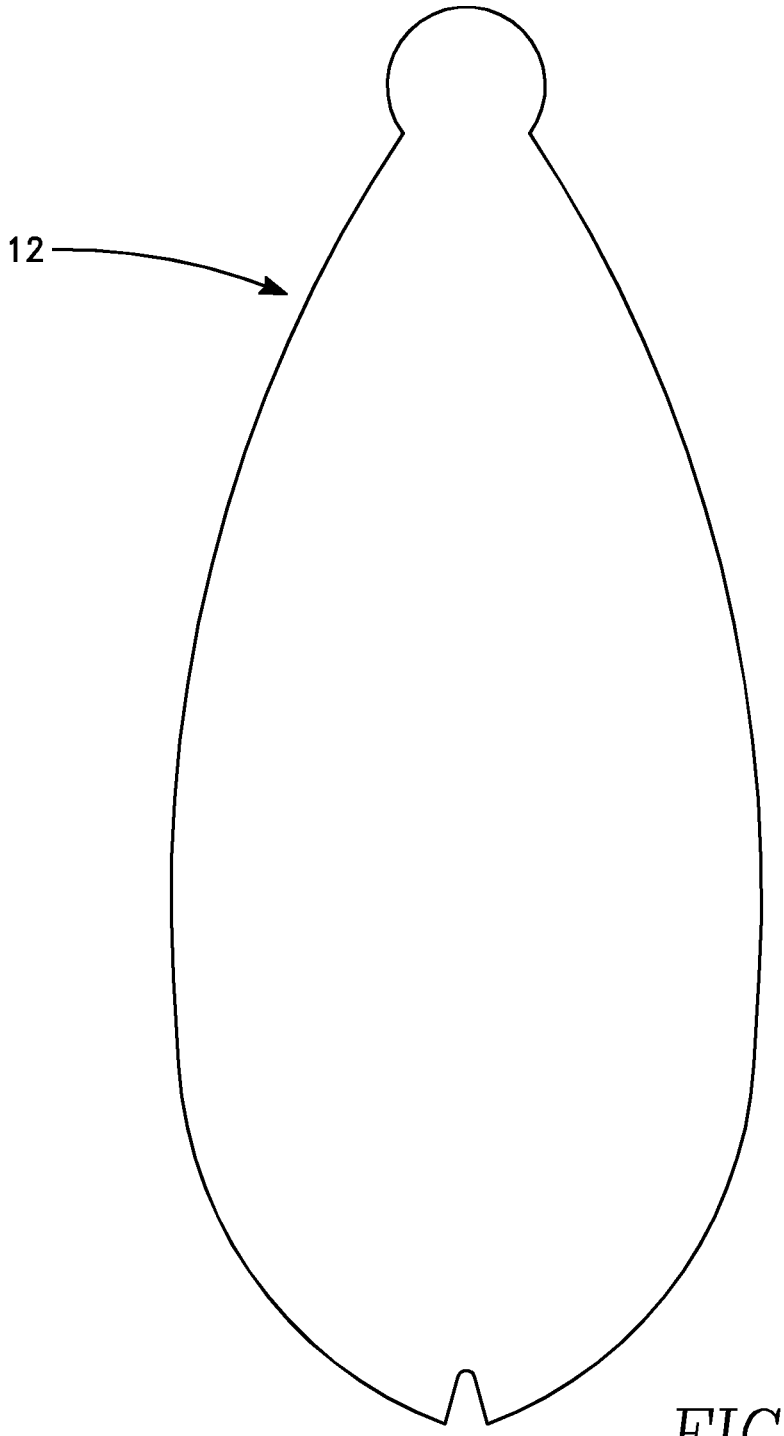
FIG. 4 is a plan view of a cutout of one embodiment of protective shield 12 of the protective device.
Figure 5:
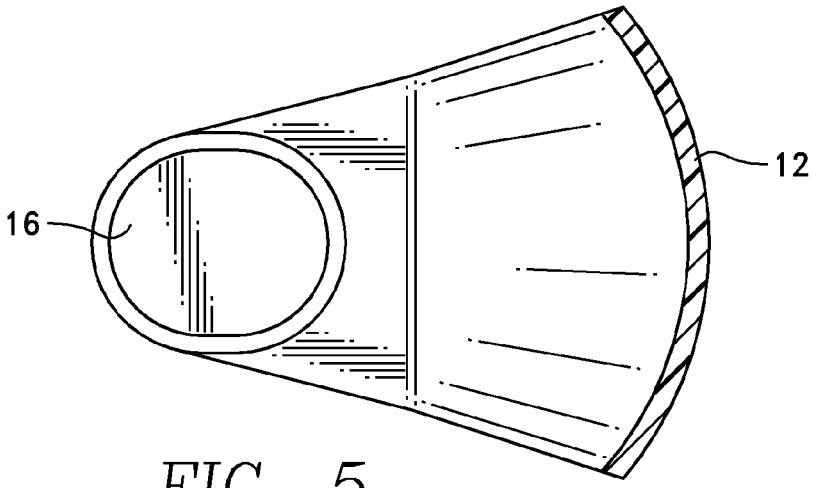
FIG. 5 is a plan view of a cutout of one embodiment of base 16 of the protective device.
Figure 6:
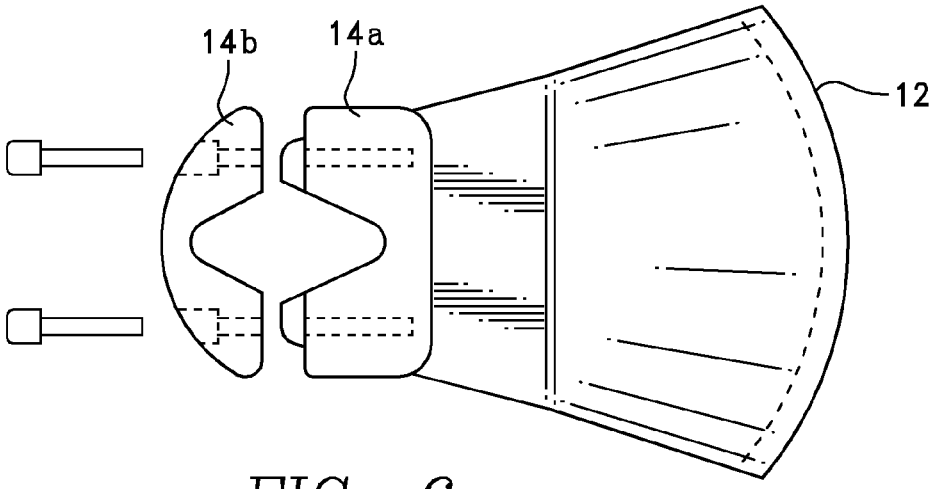
FIG. 6 is a plan view of a cutout of one embodiment of first clamp portion 14*a* and second clamp portion 14*b* of the protective device.

FIG. 4 shows a plan view of protective shield 12 as it is to be cut from the metal. FIG. 5 is a plan view of base 16, with the base being attached to a lower, interior surface of protective shield 12. FIG. 6 is a plan view of first clamp portion 14*a* and second clamp portion 14*b* being attached to an upper, exterior surface of shield 12. Attachment of the various portions of the device to one another may be in any suitable manner, including welding as described below.

Once the parts have been cut from the aluminum or other metal, clamp portions 14*a* and 14*b* can be drilled and tapped to form two holes. This can be accomplished with a ¼ 20 tap and a CNC mill. Protective shield 12 is bent using, for example, a press brake and one shot die. The properly bent and tapped parts can then be set in a fixture and welded using a Miller 210 Tig machine (Miller Electric Manufacturing Company; Appleton, Wis.). The completed protective device 10 can be coated in rubber or other protective coating for durability and safety.

Figure 7:
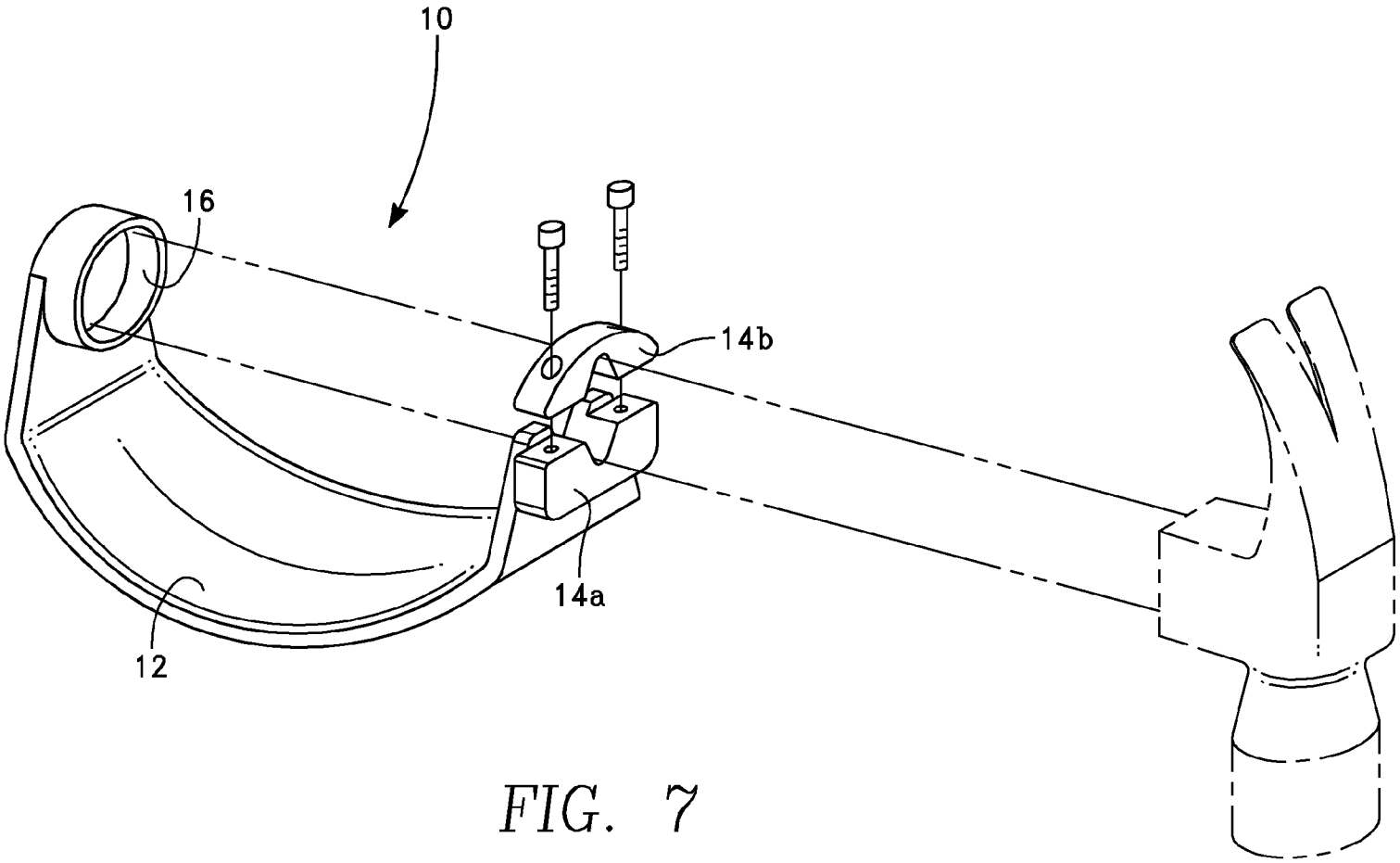
FIG. 7 is a perspective view of one embodiment of the protective device attached to a hammer.

FIG. 7 shows the completed exemplary embodiment of device 10 attached to a hammer. The embodiment shown in the Figure is clamped to the handle of the hammer, and base 16 is adapted to receive the base of the handle of the hammer, further securing protective device 10 to the hammer. A user of the hammer grasps the handle thereof at the portion of the handle between base 16 and clamp portions 14*a* and 14*b* of protective device 10.

As shown in various figures and described above, both the first clamp portion 14 and second clamp portion 14*b* preferably include openings for receipt of fasteners therethrough. Any suitable fasteners may be used such as, for example, screws or bolts. In such embodiments, the openings tapped in first clamp portion 14*a* may be threaded, whereas the openings in second clamp portion 14*b* may have a smooth bore. The threads on fasteners received within the openings in first clamp portion 14*a* mate with threads within the bores of the openings, thereby fastening first clamp portion 14*a* and second clamp portion 14*b*. The handle of the hand-held tool with which protective device 10 is being used is clamped between the two clamp portions and protective device 10 is held securely in place.

The exemplary embodiment described above is just one embodiment of the disclosure, however it is contemplated that the spirit and scope of the present disclosure encompass many additional embodiments. For example, while the embodiment described above includes a clamp 14 that secures protective device 10 to a tool, it is contemplated that protective device 10 may be formed as an integral part of the tool, where attachment of a separate device to the tool is unnecessary.

Further, in some embodiments of the disclosure, the protective shield portion 12 may be affixed directly to the handle of the tool, such as by the use of screws or other fasteners, with either or both of clamp 14 and base 16 missing. As another example, the protective device 10 may include (i) a protective shield; (ii) a first attachment portion, the first attachment portion configured to securely attach a first portion of the protective shield to a first portion of a handle of a hand-held tool; and (iii) a second attachment portion, the second attachment portion configured to securely attach a second portion of the protective shield to a second portion of the handle of the hand-held tool. The first attachment portion and the second attachment portion may include practically any mechanisms for attachment.

In addition, in some embodiments clamp 14 may be substantially as described above, but base 16 may be replaced with a second clamp that is affixed to the handle of the tool. For example, the second clamp may be affixed to an end of the handle of the tool, or alternatively, affixed to a different portion of the handle of the tool that is different than the end of the handle of the tool.

Furthermore, in some embodiments, the protective device 10 may include a sleeve or other enclosure to receive a portion of the handle of the tool. For example, the sleeve may be located between the clamp 14 and the base 16, or alternatively, between the clamp 14 and the second clamp, instead of the base 16, as discussed above. The sleeve may be located opposite of the protective shield 12, and a user may grip the sleeve instead of the handle of the tool. The sleeve may be coated in rubber or other protective coating for durability and safety.

In some embodiments of the disclosure, an attachment portion may be present on the handle of the tool, and another attachment portion on the protective shield 12, such that protective shield 12 is removable from the tool and the same protective shield 12 may be used with a variety of different tools.

While various embodiments of the present device set forth above are useful and considered within the scope of the present disclosure, it is contemplated that the embodiment shown in the drawings provides a particularly high degree of stability, including resistance to rotation and lateral movement along the handle of the hand-held tool, and therefore provides a high level of protection to the hand of a user.

The dimensions of protective device 10 may also vary widely. The device may be scaled up or down to fit on any given tool with respect to which there is a need for protecting the hand of the user. Also, the components used to construct the present protective device 10 may be varied as necessary or desired. As noted above, any suitable metal material may be used. In addition, carbon fiber or synthetic polymers having the desired degree of strength may be used in place of metal. Such variations in material and dimensions are well within the contemplated scope of the present disclosure. Many other variations or modifications to the present device will also be readily apparent to those of skill in the art upon reading this disclosure, and are also considered to be within the scope of the disclosure.

The invention claimed is:

1. A protective device for a hand-held tool, the device comprising:

a protective shield having a first end and an opposing second end;

a first clamp portion attached to the first end of the protective shield;

a second clamp portion removably attached to the first clamp portion; and a base portion attached to the second end of the protective shield, the base portion receives the distal end of the handle of the hand-held tool, the first and second clamp portions configured to securely fix a portion of a handle of a hand-held tool therebetween when the second clamp portion is attached to the first clamp portion.

2. The protective device according to claim 1, wherein the first clamp portion defines at least one opening for receiving a fastener therein, and the second clamp portion defines at least one corresponding opening for receiving a fastener therein, the protective device further comprising at least one fastener extending through the opening defined in the second clamp portion and received by the opening defined in the first clamp portion to attach the first and second clamp portions.

3. The protective device according to claim 1, wherein the first clamp portion defines a first opening for receiving a first fastener therein and a second opening for receiving a second fastener therein, and further wherein the second clamp portion defines a third opening for receiving the first fastener therein and a fourth opening for receiving the second fastener therein, the protective device further comprising a first fastener extending through the first opening and received into the third opening and a second fastener extending through the second opening and received into the fourth opening to attach the first and second clamp portions.

4. The protective device according to claim 1, wherein the base portion comprises a sidewall extending therefrom to form a pocket substantially aligned with a space defined between the first and second clamp portions and configured to receive an end of the handle of the hand-held tool.

5. The protective device according to claim 1, wherein the base portion defines an opening substantially aligned with a space defined between the first and second clamp portions to receive a portion of the handle of the hand-held tool therethrough.

6. The protective device according to claim 1, wherein the protective shield, first clamp portion, and base are constructed as a single, unitary piece of material.

7. The protective device of claim 1, wherein the hand-held tool is selected from the group consisting of hammers, mallets, axes, and picks.

8. In a hand-held tool comprising a head and a handle for grasping the tool extending from the head, the improvement comprising:

a protective shield attached to said handle and extending from said handle at a first location therealong to an end thereof the protective shield forming a base portion to receive the distal end of the tool handle, the protective shield further configured to receive a portion of a hand of a user of said device therethrough when said user is grasping the hand-held tool, the protective shield forming a barrier to shield at least a portion of said user's hand.

9. The improvement according to claim 8, wherein the protective shield has a concave curvature along at least a portion of its length that extends over the hand of the user.

10. The improvement according to claim 8, wherein the protective shield is removably attached to the hand-held tool.

11. The improvement according to claim 8, wherein the protective shield is formed as a unitary, integral component of said hand-held tool.

12. The improvement according to claim 8, wherein the hand-held tool is selected from the group consisting of hammers, mallets, axes, and picks.

13. A protective device for a hand-held tool, the device comprising:

a protective shield;

an attachment portion, the attachment portion configured to secure a first portion of the protective shield to a first portion of a handle of a hand-held tool; and a base, the base comprising a sidewall extending therefrom to form a pocket to receive the distal end of a handle of the hand-held tool.

14. The protective device according to claim 13, wherein the attachment portion comprises a clamp releasably attached to the first portion of the handle of the hand-held tool.

15. The protective device according to claim 13, further comprising a sleeve, the sleeve comprising a first, open end attached to said attachment portion and a second, opposing end attached to said base, the sleeve configured to receive a portion of the handle of the hand-held tool through the first, open end thereof.

16. The protective device according to claim 15, wherein the protective shield, attachment portion, base, and sleeve are formed as a unitary, integral device.

17. The protective device according to claim 15, wherein the sleeve comprises a protective coating.

18. The protective device according to claim 13, wherein the hand-held tool is selected from the group consisting of hammers, mallets, axes, and picks.

* * * * *